US005562205A

United States Patent [19]

Diaz

[11] Patent Number: 5,562,205

[45] Date of Patent: Oct. 8, 1996

[54] BEVERAGE CAN COVER AND CARRIER

[76] Inventor: Eusebio M. Diaz, 6450 Balboa Blvd., Van Nuys, Calif. 91406

[21] Appl. No.: 406,536

[22] Filed: Mar. 20, 1995

[51] Int. Cl.[6] ..... B65D 71/00; B65D 85/62

[52] U.S. Cl. ..... 206/151; 294/87.2

[58] Field of Search ..... 206/150, 151, 206/158, 145; 229/103.1; 220/705, 710; 294/87.2

[56] References Cited

U.S. PATENT DOCUMENTS

| | | | |
|---|---|---|---|
| 3,189,171 | 6/1965 | Miller | 229/103.1 X |
| 3,202,448 | 8/1965 | Stern et al. | 206/151 X |
| 3,250,564 | 5/1966 | Stern et al. | 294/87.2 |
| 3,302,854 | 2/1967 | Midgley et al. | 206/151 X |
| 3,350,131 | 10/1967 | Tanzer | 294/87.2 |
| 3,664,497 | 5/1972 | Mascia | 206/151 |
| 3,752,305 | 8/1973 | Heyne | 294/87.2 X |
| 4,043,478 | 8/1977 | Duncan | 220/710 |

*Primary Examiner*—Bryon P. Gehman
*Attorney, Agent, or Firm*—Roger A. Marrs

[57] ABSTRACT

A plurality of beverage cans having reclosable covers is disclosed herein in combination with a detachable carrier wherein each cover is disposed on the top of a beverage can with the carrier releasably separating the beverage cans from each other. Each cover includes a body or disc having a downwardly depending peripheral hinge secured to the sidewall of the beverage can. The cover body includes a circular recess adjacent to the flange to permit stacking of other cans. The flange terminates in an inwardly disposed end portion for tightly sealing with the can and further includes a row of perforations for releasing the cover from the end portion via a pull strip. The carrier is releasably attached to the edge of the end portion by by perforations so that individual cans can be separated from the carrier leaving only a web of reduced area for ultimate disposal.

9 Claims, 2 Drawing Sheets

FIG. 1
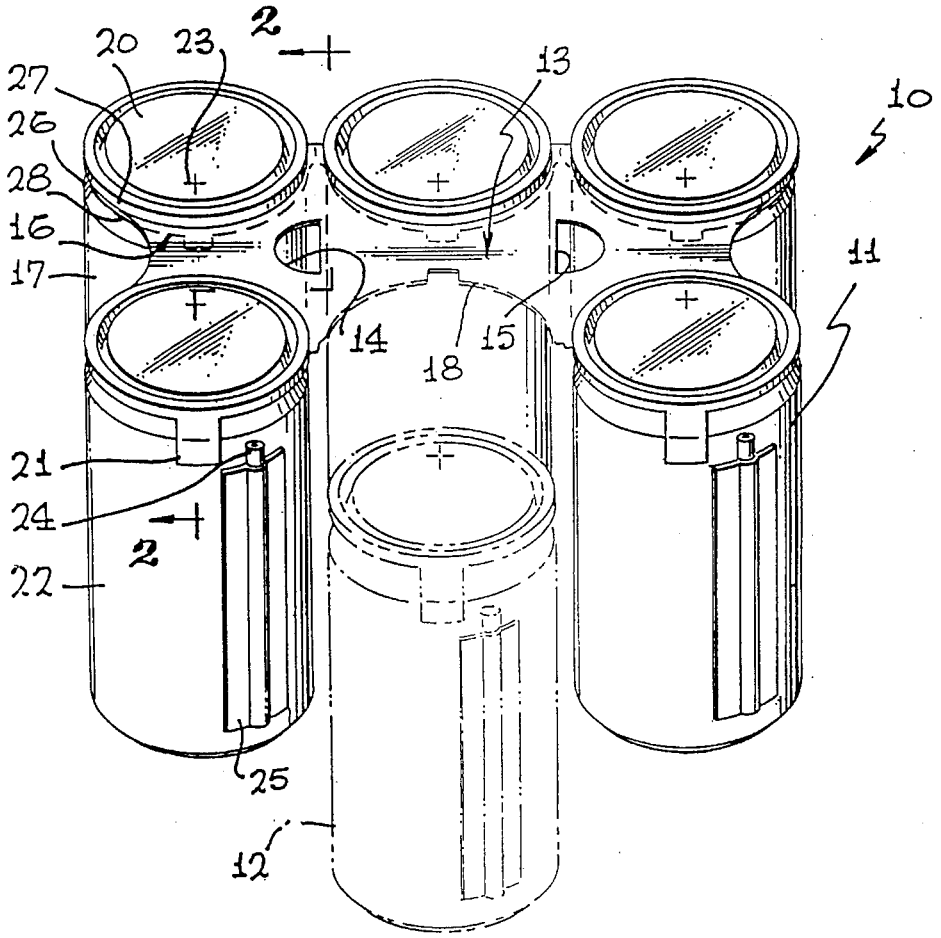
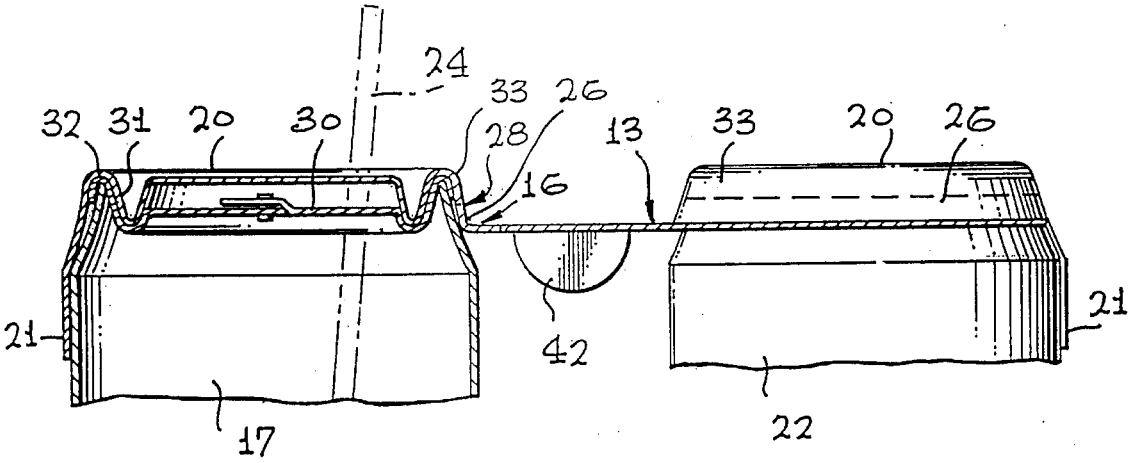
FIG. 2

FIG. 3
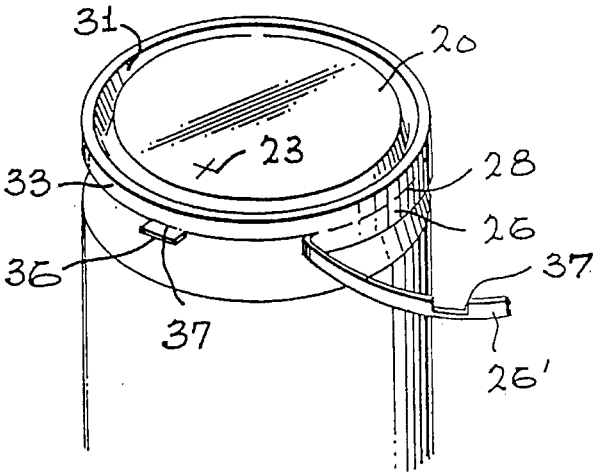
FIG. 4
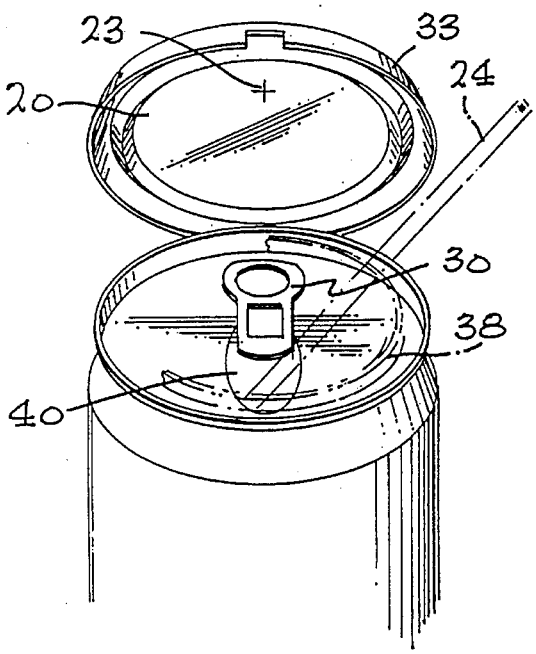
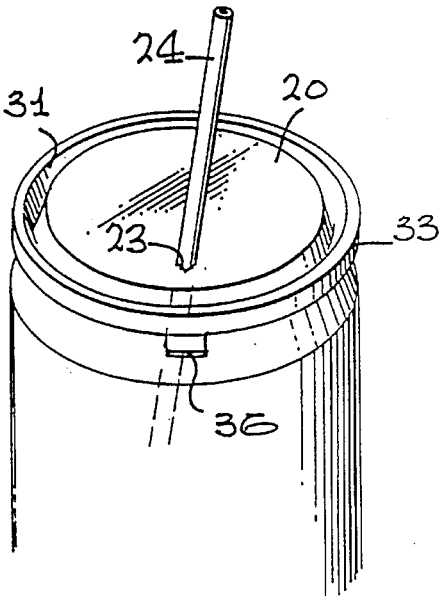
FIG. 5
FIG. 6
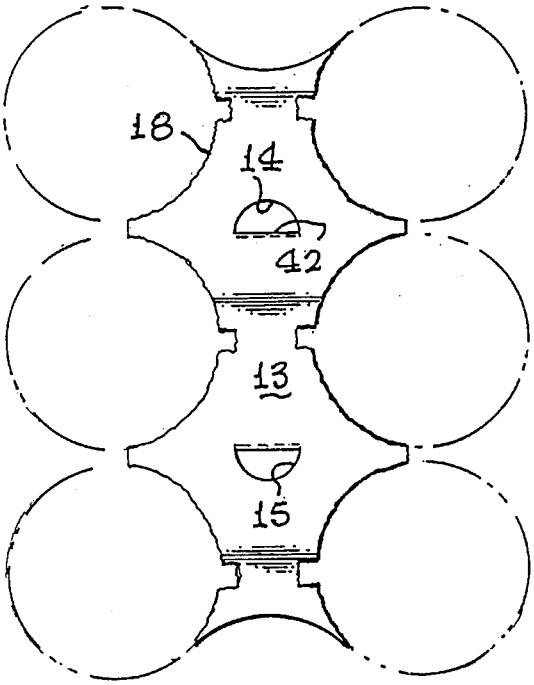

BEVERAGE CAN COVER AND CARRIER

BACKGROUND OF THE INVENTION

1. Field of the Invention

The present invention relates to the field of combined beverage can covers and carriers, and more particularly to a novel beverage can cover which not only seals and provides stackability features, but further includes a carrier for accommodating a plurality of beverage cans during transport.

2. Brief Description of the Prior Art

In the past, it has been the conventional practice to provide temporary lids or covers for beverage cans which purport to seal the can before use and after use. Also, a multiplicity of carriers have been devised for use in transporting a plurality of beverage cans or containers-from one place to another. Examples of devices pertaining solely to lids or covers are disclosed in U.S. Letters Pat. Nos. 5,139,163 and 5,273,176. Examples of prior beverage container transport devices or carriers are represented by the rigid wire carriers used for milk bottles, or in more recent years, cardboard or plastic sheets which frictionally hold a plurality of cans within separate loops integrally and permanently formed with a center portion of the sheet.

Problems and difficulties have been encountered with both prior sealing devices for beverage cans as well as carriers, which stem largely from the fact that the adequate sealing is questionable after the opening of a can as well as proper positioning for stacking in the event a plurality of the containers are stacked or nested together. Also, disposal of prior carriers is environmentally difficult inasmuch as the closed loops on discarded carriers cause problems in animals or birds becoming entangled as well as other obstacles which may catch on the loops thereof. Furthermore, straws which are normally used for withdrawing contents from the beverage can or containers are separate from the container itself and are longer than is necessary to withdraw the contents from the bottom of the can.

Therefore, a long-standing need has existed to provide a novel hygienic seal, cover and carrier for food and drink containers which are unitary in construction so that a single combined cover and carrier is available for transporting a plurality of beverage cans from place to place and which will properly seal each of the respective cans of the plurality as-well as providing a reusable cover after the can has been separated from the carrier.

SUMMARY OF THE INVENTION

Accordingly, the above problems and difficulties are avoided by the present invention which provides a novel combined reclosable cover and carrier for beverage cans, which includes a carrier composed of a flexible sheet of material which is joined to a plurality of covers and is separated therefrom by perforations. Each of the respective covers includes a sealing and attachment means to respective cans whereby the cover is hingeably attached to each of the respective cans and by employing a detachable tab means, the cover is released from its sealing engagement with the can. By use of the hinge, the cover becomes reclosable after the seal has been broken. The carrier sheet detached from the respective covers is void of any loops or other environmentally objectionable design features. Furthermore, a straw is carried in a holder secured to the side of each can, releasably storing a straw of reduced length as compared to the height of the beverage can.

Therefore, it is among the primary objects of the present invention to provide a novel combined beverage can cover, seal and carrier for a plurality of containers which is integral in its construction and which is environmentally acceptable for disposal after use.

Another object of the present invention is to provide a novel combined beverage can cover and sealing means, as well as a carrier for a plurality of cans, which is integrally formed and which provides a straw means for extracting liquid contents from the container and particularly without total removal of a sealed lid from the container.

A further object of the present invention is to provide a novel single-piece carrier and beverage can seal and reclosable cover which can be readily separated from the single construction at the selection of the user whereby a plurality of beverage cans can be transported from one place to another and separately removed for singular usage.

A further object resides in providing an environmentally friendly combined beverage can carrier and covering and sealing means which is convenient to use and which may be readily disposed of after use without encountering above noted problems.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

FIG. 1 is a front perspective view of the combined beverage can closure and carrier means incorporating the present invention and illustrated in combination with a plurality of beverage cans;

FIG. 2 is an enlarged sectional view of the combined beverage can closure and carrier, as shown in FIG. 1 in the direction of arrows 2—2 thereof;

FIG. 3 is a perspective view of a beverage can closure with a tab means partially pulled from the seal in order to free the cover or lid;

FIG. 4 is a view similar to the view of FIG. 3 illustrating the cover in its position to be reclosed after removal of the pull tab;

FIG. 5 is a view .similar to the view of FIG. 4 illustrating the lid or cover reclosed over the top of the beverage can with a straw in place for extracting liquid contents; and FIG. 6 is a top plan view of the carrier portion of the invention after removal and separation from the plurality of beverage cans shown in FIG. 1.

DESCRIPTION OF THE PREFERRED EMBODIMENT

Referring to FIG. 1, the novel combined beverage can closure and carrier is indicated in the general direction of arrow 10 wherein a plurality of beverage cans, such as can 11, is combined with the closure and carrier to form a unitary package. Each of the respective cans can be separated from a common carrier by severing perforations associated with a selected one of the cans intended to be removed. As illustrated in broken lines, can 12 has been separated from the carrier wherein the remaining cans are still connected together.

The combined beverage can closure means and carrier includes a central sheet of flexible material, indicated by numeral 13, which has a central portion in which a pair of spaced-apart cutouts 14 and 15 are disposed. The cutouts are employed to be grasped by the thumb and index finger of the user so that the package may be carried or transported from place to place. During such transportation, the plurality of beverage cans are firmly supported and held in place. The carrier includes a plurality of semicircular perforations 16 associated with beverage can 17. The can 17 may be removed from the carrier by pulling and/or twisting the can so that the perforations 17 will break apart leaving only an open edge, such as edge 18 associated with the removed beverage can 12.

Each of the beverage cans includes a closure and sealing means which is broadly indicated by numeral 20 with respect to can 17 and such a means is secured to each of the respective cans by means of a hinge, as indicated by numeral 21 associated with can 22. The numerals 20 and 21 are used with respect to the beverage can closure means and the hinge for each and every one of the respective cans and are therefore repeated for each and every one of the cans even though the cans have a separate number.

FIG. 1 also discloses a slitted opening 23 associated with each of the cover means 20 so that a straw may be inserted therethrough when the cover or lid has been reclosed. Also, a straw 24 associated with each of the cans is illustrated as being stored in a receptacle 25 suitably attached to the outside exterior surface of the can. It is to be particularly noted that the length of the straw 24 used to extract liquid contents from the can interior is of a shorter length than the height of the can. The use of the straw will be described later. The means for unsealing each of the respective lids or covers 20 may be affected by a pull strip or tab, identified by numeral 26, which is connected to the main flange of the cover, indicated by numeral 27, via a series of perforations 28.

Referring now in detail to FIG. 2, it can be seen that the perforations 16 are employed for separating each beverage can from the body of carrier 13 while the perforations 28 are employed for removing the lid or cover 20 from its sealed position about the top of the can so that the cover or lid 20 may be positioned on hinge 21 to open and close the beverage can. It can be seen that each beverage can includes an opening which is covered by a finger tab 30 which is sealed by means of the cover 20. The hygienic seal and cover is mounted on the top of a conventional "pop-top" can and the combined seal and cover includes the cover body 20 having a raised area surrounded by a recess or groove 31 of circular configuration in plan view and which further includes a shoulder 32 which supports a downwardly depending sealing flange 33. The cover or cover body further includes the hinge 21 which is integrally formed with the flange 33 and is secured to the sidewall of the can by any suitable attachment at an attachment area which is flat. Numeral 34 indicates the attachment area while the numeral 21 indicates the flexible hinge which is not attached to the sidewall of the container.

The downwardly depending flange 33 curves inwardly towards the circular groove 31 providing a reduced area that is intended to fit over the top of the can's peripheral edge. Inasmuch as the flange is flexible due to the composition of the lid or cover body, the flange will expand or spread slightly when the peripheral can edge is forced into the receptacle or open area so defined. Thus, the improved seal is provided for reclosure by the user. Also, it is to be noted that the groove 31 is on the exterior of the cover body so that it will nest with the downwardly projecting underside of another can which is placed on top in stacked relationship. Such a downwardly projecting element is illustrated by numeral 35 in FIG. 1 on the underside of can 22.

Referring now in detail to FIG. 3, it can be seen that the lid or cover body 20 may be separated from its sealing position with respect to the beverage can by withdrawing the pull tab or tear strip 26 via perforations 28 from the sealing flange. Before separation, the tear strip 26 is a part of flange 23 and effects the seal. However, when the tab has been withdrawn, as shown in FIG. 3 by tear strip 26', the cover body is free to move about its respective hinge. It is also to be noted that the flange 33 includes provision for a tab 36 that is attached to the cover body 20 via a fold line 37. Therefore, when the pull strip 26 has progressed along its perforated line 28, a notch 37 remains in the tear tab or pull tab which was previously occupied by the tab 36. Therefore, a tab is provided on the lid and is exposed when the pull tab has been fully stripped from flange 33. As illustrated in FIG. 3, the end of the tear strip 26 is separated from the hinge on the backside of the can and the strip is separated from flange 33 about the entire circumference of the can until the opposite side of the hinge has been reached when the pull tab is now separated completely from the can.

The separated pull strip is now identified in the FIG. 4 by numeral 38 and may be placed on top of the can so that it can be closed and sealed by the cover 20 after the contents of the can have been consumed. In this manner, disposal of the pull tab is within environmental requirements since both the lid and tear strip form a disposable unit with the can. If desired, the pull strip may also be introduced into the dispensing opening 40 of the can followed by closure of the lid or cover body 20. It can be seen in FIG. 4 that nothing remains on the body of the can after removal of the sealing and tear strip 26 and that the lid can be in the open position to permit the straw 24 to be introduced through the opening 40. If desired, once the pull strip 26 has separated the sealing closure of the lid 20 with respect to the can, the tab 30 associated with the can opening 40 may readily be pivoted to its open position by inserting the tab 26 under the tab followed by an upward pull. In this manner, the user's fingernails or separate tools are not needed to force the tab away from opening 40.

With respect to FIG. 5, it can be seen that once the pull tab or tear strip 26 has been removed, the lid may be opened, as previously described, to show that the metal tab 30 can be removed to expose dispensing opening 40 through which the straw 24 may be placed. The straw may either be used with the lid open, as shown in FIG. 4, or when the lid is closed, the straw may be introduced through the weakened portion 23 of the cover 20 and then inserted through opening 40 for extraction of fluid contents. For opening and closing of the lid or cover body 20, the tab 26 may be employed for grasping by the fingers of the user. A feature of the invention resides in providing the length of the straw 24 of a lesser dimension or shorter than the height of the beverage can. In order to extract liquid contents that may reside at the very bottom of the container, the user need only tip the container to one side and this will cause the fluid to reside at a higher level so that the shorter straw will reach the contents.

As shown in FIG. 6, once the beverage cans have been removed from the carrier portion of the combination, all that is left is the central section, indicated by numeral 13. There are no loops or other protrusions which would cause problems with respect to animals, fowl or other obstructions. The ragged edge 18 is all that remains of the separation of the cover and sealing means portion of the combination. The cutouts 14 and 15 are very small and pose no disposal problem. If it is desired to close the cutouts, the separated portion, indicated by numeral 42 in FIG. 2 may be urged back into the cutout from which it was folded.

Therefore, in view of the foregoing, it can be seen that the combined cover and sealing means along with the carrier provides an integral and unitary construction for holding a plurality of beverage cans and wherein the plurality of beverage cans may be readily stacked with additional quantities of beverage cans. Also, the environmental advantages of the invention are that the residue of the carrier and sealing means results in tear strips or pull tabs that are carried under the cover which is integral with the can for disposal purposes. The other element is the carrier 13 which contains no loops as is the conventional practice.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A combined beverage container sealed cover and carrier comprising:

a sheet of material having a central carrier portion with a plurality of cover portions provided about an edge marginal region of said sheet of material;

a plurality of perforations releasably joining each of said cover portions with said central carrier portion;

each of said cover portions having a hinge member permitting its associated cover portion to move between an open position and a closed position;

each of said cover portions having a cover body with a peripheral downwardly depending flange: and a respective tear strip located on each cover portion; said tear strip detachably carried on said flange and having opposite ends separated by said hinge member.

2. The invention as defined in claim 1 wherein:

each respective said tear strip detachably connected to its respective said flange by a series of perforations.

3. The invention as defined in claim 2 including:

a respective tab foldably connected with each said cover body and defined by said series of perforations so as to be exposed when a respective said tear strip has been detached from its said flange.

4. The invention as defined in claim 3 including:

a beverage container detachably connected with each of said cover portions in sealing relationship with its said flange; and each said hinge member is secured to one respective said beverage container.

5. The invention as defined in claim 3 wherein:

said central carrier portion and said cover portions constitute a unitary construction.

6. The invention as defined in claim 1 wherein:

said central carrier portion is provided with a pair of spaced-apart cutouts disposed between said edge marginal regions and adapted to insertably receive the thumb and index finger for carrying purposes.

7. The invention as defined in claim 1 wherein:

each of said cover portions includes a flat disc top; and detachable sealing means releasably carried on said cover portion downwardly depending from said flat disc top.

8. The invention as defined in claim 1 including:

a respective receptacle secured to the sidewall of a respective each beverage and food container; and a straw removably carried each said receptacle for extracting liquid from its respective said beverage and food container.

9. The invention as defined in claim 8 wherein:

each said beverage and food container has a given height and said straw having a length less than said beverage and food container height.

* * * * *